United States Patent [19]

Henricks

[11] 4,326,899

[45] Apr. 27, 1982

[54] METHOD OF CONTINUOUS ANNEALING LOW-CARBON ELECTRICAL SHEET STEEL AND DUPLEX PRODUCT PRODUCED THEREBY

[75] Inventor: Arthur R. Henricks, Franklin Township, Westmoreland County, Pa.

[73] Assignee: United States Steel Corporation, Pittsburgh, Pa.

[21] Appl. No.: 75,785

[22] Filed: Sep. 17, 1979

[51] Int. Cl.[3] ..... H01F 1/00

[52] U.S. Cl. ..... 148/120; 148/16; 148/39; 148/31.55

[58] Field of Search ..... 148/120, 121, 122, 16, 148/16.7, 31.55, 39

[56] References Cited

U.S. PATENT DOCUMENTS

| | | | |
|---|---|---|---|
| 3,188,250 | 6/1965 | Hobein et al. | 148/120 |
| 3,196,054 | 7/1965 | Carpenter | 148/111 |
| 3,215,566 | 11/1965 | Mayer | 148/16 |
| 3,406,047 | 10/1968 | Magor et al. | 148/39 |
| 3,865,638 | 2/1975 | Ballantyne et al. | 148/39 |

FOREIGN PATENT DOCUMENTS 461136 2/1975 U.S.S.R. .

*Primary Examiner*—John P. Sheehan
*Attorney, Agent, or Firm*—Forest C. Sexton

[57] ABSTRACT

A process for producing a low-carbon electrical sheet steel having a superior and unique duplex microstructure having a mid-section of fine-grained ferrite with dispersed carbide precipitates and a coarse grained surface of ferrite without significant precipitates. The unique microstructure is effected by a duplex continuous anneal wherein the steel is first decarburized annealed at 1350°-1500° F. for a time sufficient to decarburize only the surface, and thereafter heat treated to austenitize the steel, followed by controlled cooling to effect the above-described microstructure.

8 Claims, 1 Drawing Figure

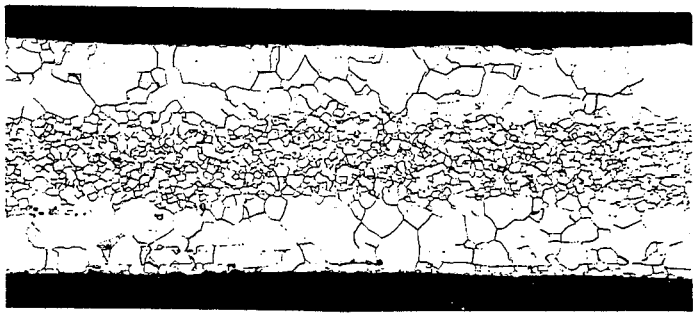

METHOD OF CONTINUOUS ANNEALING LOW-CARBON ELECTRICAL SHEET STEEL AND DUPLEX PRODUCT PRODUCED THEREBY

BACKGROUND OF THE INVENTION

Because of their superior magnetic properties, silicon sheet steels are widely used in the production of magnetic core components in electrical equipment such as motors, generators, transformers, and the like. These favorable magnetic properties, namely, high magnetic permeability, high electrical resistance and low hysteresis losses, will minimize wasteful conversion of electrical energy into heat, and will therefore permit manufacture of electrical equipment having greater power and efficiency. In order to effect and optimize the desired magnetic properties, however, the silicon sheet steels must be produced under carefully controlled and exacting processing parameters. Silicon sheet steels are therefore substantially more expensive than other more conventional flat rolled steel products.

In the high volume manufacture of small electrical equipment for consumer appliances, toys and the like, unit cost is perhaps the most important consideration, for outweighing equipment efficiency and power considerations. For these applications, therefore, electrical equipment manufacturers frequently utilize the less expensive, more conventional low-carbon sheet steels for magnetic core components. Hence, there is a considerable market for low-carbon sheet steels having acceptable magnetic properties for magnetic core applications.

In the course of producing low-carbon sheet steels for magnetic applications, economic considerations have dictated that expensive processing steps be avoided and that even inexpensive steps be minimized. Therefore, even though elaborate processes have been developed for producing low-carbon sheet steels having exceptional magnetic properties, such processes have not been adapted commercially, because the use of such processes would greatly add to the cost of the product, while not improving the magnetic properties of the resultant sheet sufficiently to equal those of silicon sheet steels having comparable cost of production. To be of any commercial value, therefore, any new process for improving the magnetic properties of low-carbon sheet steels must be one that will not significantly increase the steel's production cost. Commercially, therefore, low-carbon sheet steels for magnetic applications are produced from conventional low-carbon steel heats having less than 0.1 percent carbon and the usual residual elements at normal levels for cold-rolled products. The rolling procedures are similar to those used for other cold-rolled products. Specifically, the production steps are usually limited to hot-rolling a lowcarbon ingot to slab form; hot rolling the slab to sheet form; pickling the hot rolled sheet, cold rolling the pickled sheet for a reduction of 40 to 80 percent; and annealing the sheet to effect recrystallization, generally in a box annealing furnace. An optional final temper roll or stretch leveling of from ½ to 8 percent is sometimes provided for the purpose of improving core loss and/or flattening the resultant sheet to make it better suited for the end application, slitting and lamination stamping.

The commercially produced low-carbon sheet steels for magnetic applications of 18.5 mils thickness, and having a lamination anneal, typically exhibit permeabilities in the rolled direction of from 5000 to 6000 at 10 kilogauss, with core losses of from 1.3 to 1.6 watts/lb. For the same thickness at 15 kilogauss, permeabilities in the rolled direction typically range from 2000 to 4000 with core losses of 3.0 to 4.0 watts/lb. Sheets rolled to 25 mils typically exhibit permeabilities in the rolled direction of from 4200 to 4800, with core losses of 1.8 to 2.0 watts/lb. at 10 kilogauss; and permeabilities in the rolled direction of from 2000 to 3000 with core losses of 4.2 to 4.8 watts/lb. at 15 kilogauss.

These relatively wide ranges in magnetic properties reflect an established tendency on the part of industry to deemphasize magnetic properties in low-carbon sheet steel and emphasize low cost of production. Nevertheless, customers have recently begun to demand improved magnetic properties, particularly at 15 kilogauss, without an appreciable increase in cost. As noted above, producers have been hard pressed to improved magnetic properties in these steels without substantial increases in production costs.

One of the more costly steps in producing the low-carbon electrical sheet steels is the box annealing which is a rather protracted operation. In addition, box annealed coils usually have coil-set which necessitates subsequent leveling operations. Because of this, there have been efforts to utilize continuous annealing in place of the more conventional box annealing operation. This, of course, is much cheaper than the box anneal-temper roll and/or stretch level treatment and may eliminate the need for a leveling step. However, the continuous anneal treatment does not yield magnetic properties as good as the box anneal temper/-stretch treatment, and hence few of these efforts have been utilized commercially without involving additional processing steps to improve magnetic properties.

SUMMARY OF THE INVENTION

This invention is predicated upon my conception and development of a method for continuous annealing low-carbon electrical sheet steel which not only reduces the cost of producing the sheet steel, but further provides a unique duplex microstructure having magnetic properties at least comparable to those achieved with box annealing. In addition, the duplex microstructure renders improved punchability to the sheet, i.e. reduced die wear, has an improved response to lamination annealing and improved flatness, and is further characterized by excellent magnetic properties without a lamination anneal.

Accordingly, a primary object of this invention is to provide a new process for producing an improved low-carbon electrical sheet steel which requires lower cost continuous annealing instead of the more costly box annealing, temper rolling and/or stretch leveling as is common in the prior art.

Another object of this invention is to provide a unique method of continuous annealing low-carbon electrical sheet to produce a duplex microstructure having exceptional magnetic properties, improved flatness and improved punchability.

A further object of this invention is to provide a new and improved low-carbon electrical sheet steel having a unique duplex microstructure having exceptional response to lamination annealing, improved flatness and improved punchability.

A still further object of this invention is to provide a new and improved fully processed, low-carbon electrical sheet steel having excellent magnetic properties without a lamination anneal.

These and other objects and advantages will become apparent from the description below.

BRIEF DESCRIPTION OF THE ILLUSTRATION

The attached FIGURE is a photomicrograph of a section through the improved low-carbon electrical sheet steel produced in accordance with this invention showing the unique duplex microstructure. The strip is 0.018-inch thick. 100×magnification.

DESCRIPTION OF THE PREFERRED EMBODIMENT

In the preferred practice of this inventive process, the steel is first cold rolled pursuant to conventional prior art practices. Typically, this involves production of a low-carbon steel normally containing 0.06% max. carbon, 0.20 to 0.80% manganese, 0.015% max. silicon, 0.025% max. sulfur and normal residual impurities. For optimum magnetic properties, it is preferable that the steel be rephosphorized to 0.12 to 0.18% phosphorus and 0.30 to 0.50% manganese as taught in co-pending patent application Ser. No. 863,115 to Regitz. In addition, magnetic permeability can be optimized by the special deoxidation practices as taught and claimed in the above-cited pending application. The steel heat, with or without the phosphorus and manganese adjustments and with or without the special deoxidation practice, is either continuous cast to slab form, or cast as ingot and the ingots subsequently hot rolled to slab form. The slabs are then hot rolled to hot-band gage, i.e. 0.070 to 0.130-inch with a finishing temperature usually within the range 1550° to 1600° F. and then coiled at a temperature below 1150° F. This will, of course, require some water-spray cooling on the run-out table following the last stand before the steel is coiled. The coiled steel is then pickled in conventional pickling solutions, such as hydrochloric or sulfuric acid, to remove mill scale, and then cold rolled to the desired nominal final gage, usually within the range 0.016 to 0.036-inch. After this cold roll, the steel is usually box annealed at a temperature between 1100° and 1300° F. for a time sufficient to insure that all portions of the coil are at the designated temperature for one hour to assure complete recrystallization of the steel and then temper rolled and/or stretch leveled to achieve flatness and/or critical strain.

The crux of this invention resides in eliminating the above-described box annealing-temper rolling and/or stretch leveling steps, and instead continuous annealing the cold rolled steel sheet pursuant to carefully controlled parameters described below.

With reference to the continuous anneal of this invention, it is necessary to use a roller-hearth furnace, or any such furnace capable of maintaining three controlled environments. The furnace I have used is a commercial roller-hearth furnace which includes coil-payoff reels, strip welder, horizontal looping equipment and electrolytic cleaning, scrubbing and drying units. The entry section is joined to a contiguous horizontal heat-treating section consisting of a gas-fired heating zone 74 feet long, an electrically-heated holding zone 600 feet long, a controlled cooling zone 200 feet long, and a jet-cooling zone 90 feet long. The exit section consists of a horizontal looping unit and tension reel. The strip is supported as it passes through the heat-treating sections of the furnace in a catenary fashion by individually-motor-driven rolls. The above-detailed description is provided merely to illustrate one furnace successfully utilized in the practice of this invention, as obviously other dimensions and designs could be successfully utilized.

According to the preferred practice of this inventive process, the cold rolled sheet steel, as described above is given a two-stage continuous anneal wherein the strip is first heated to a lower annealing temperature in the first heat-treating section, i.e. heated to a temperature within the range 1350° to 1500° F. in a decarburizing atmosphere, followed by a higher temperature soak, i.e. 1550° to 1750° F. in a neutral atmosphere in the second heat-treating section to austenitize the microstructure, and finally controlled rapid cooled. The decarburizing atmosphere utilized in the first heat-treating section is preferably in accordance with that described in U.S. Pat. No. 3,958,918, i.e. an atmosphere having a hydrogen content of at least 20% with a hydrogen to water vapor ratio of from 5:1 to 8:1. One particularly critical and unusual feature of this inventive process is that the strip line-speed and length of the decarburizing zone be adjusted so that the strip is not decarburized to the fullest extent practical as is common to prior art practices. That is to say, pursuant to this invention the object of the initial heat treatment is to decarburize the surface of the steel strip without decarburizing the core. Hence, the desired product should have a core containing approximately the original carbon content of about 0.02 to 0.04%, and a surface layer of steel containing less than 0.005% carbon. To effect this result, I have found it necessary to decarburize the strip sufficiently to obtain a decarburized surface layer with coarse grains of at least 0.002-inch depth for conventional lamination grades, i.e. those which will be lamination annealed after stamping, and 0.0035-inch minimum depth for fully processed grades, i.e. those used without lamination annealing. Further decarburization can of course be accomplished with some improvement in core loss, but with a corresponding reduction in thickness of the higher carbon fine-grained core, and accordingly a decrease in overall hardness and punchability. The total extent of decarburization to be effected must therefore be a compromise between desired magnetic properties and punchability and the customer's requirements.

As should be obvious to an artisan, the depth of decarburization will of course be a function of the decarburization atmosphere used, temperature of the steel, line-speed and equipment used, i.e. length of decarburization zone. Increasing or decreasing the depth of decarburization can easily be effected by changing the line-speed inversely proportional without changing the other parameters.

After the above unusual partial decarburization step is effected in the first heat-treating zone, the steel is heated to a somewhat higher temperature in the second heat-treating zone, i.e. 1550° to 1750° F. This heat treatment serves to further austenitize the strip so that upon the subsequent controlled cooling treatment, the non-decarburized mid-section of the strip is transformed to ferrite having a finely dispersed carbide precipitate that imparts a high degree of stiffness in the product. This secondary heat-treatment, a soak at 1550° to 1750° F., is effected in a non-decarburizing-non-oxidizing atmosphere, for example, 50% hydrogen with a dew point of 35° F. maximum, balance nitrogen, and is maintained for approximately 30 seconds.

Following the austenitizing heat-treatment in the second heat-treating zone, the steel is rapidly cooled in a dry hydrogen-nitrogen atmosphere in the third and last zone. This practice is of course conventional in most continuous annealing practices, and serves to cool the steel sufficiently when the steel is exposed to air upon exiting the furnace. In this process, the cooling rate is made as rapidly as possible to minimize carbon diffusion from the steel core to the decarburized surface. As in typical continuous annealing operations, the steel exists the furnace at temperatures below about 200° F. Subsequently, the steel strip may be side-trimmed, slit and/or coated pursuant to conventional practices to meet customer specifications.

The product produced according to the above description is characterized by an unusual duplex microstructure wherein the mid-section consists of fine grained ferrite having finely dispersed carbide precipitates, while the surface layers consist of coarse grained ferrite substantially free of any precipitates. Reference to the attached photomicrograph will illustrate this duplex microstructure. When a magnetic field is applied to this sheet product, a large portion of the magnetic flux is carried by the decarburized skin where, at high inductions of 15 KG, the magnetic flux normally concentrates. Hence, the fine grained mid-section with precipitated carbides has only a limited effect on the magnetic flux carrying capability of the sheet. On the other hand, the nature of the mid-section does provide a significant advantage in providing stiffness to improve punchability and thus reduce die wear in the customer's punching operations. In addition, the tension-stretching during the continuous anneal provides a product of exceptional flatness without the need for any subsequent leveling operation such as temper rolling. In addition to these advantages, the unique product, due to its improved punchability, will maintain a good low core loss level in the as-sheared condition, thus enhancing its suitability for applications in motor laminations without the need for a lamination anneal. Nevertheless, the product does show an improved response to lamination annealing, by providing grains of primary ferrite at the sheet interfaces which grow inwardly during the lamination anneal to produce an overall final texture more amenable to the passage of magnetic flux at lamination interfaces, which in turn serves to improve core loss and permeability values.

EXAMPLE

To illustrate the advantages of this invention, the table below lists the properties achieved on a production heat processed pursuant to this invention. For this trial, a heat of steel containing 0.02% carbon, 0.54% manganese, 0.017% sulfur, 0.07% silicon and rephosphorized to 0.13% phosphorus was produced and cold rolled to sheet pursuant to conventional practices. Coils from this heat were cold rolled to 0.018-inch, 0.022-inch, 0.023-inch, and 0.025-inch and continuous annealed as described above, being decarburized at 1450° F. in an atmosphere of hydrogen, nitrogen and water vapor with a 6 to 1 hydrogen to water ratio. The secondary heat-treatment was at 1600° F. No temper-rolling or stretch-leveling operations were performed. All coils were tested in the as-sheared condition and after a lamination-type aneal at 1450° F. to further develop magnetic properties. After the lamination-type anneal, all of the test results met the guarantee for 2-S type product as defined in ASTM Specification A-726. Depth of decarburization coarse-grained skin averaged 3.5 thousandths.

TABLE

| | | AS SHEARED | | SIMULATED LAMINATION ANNEAL - 1450° F. FOR ONE HOUR | |
|---|---|---|---|---|---|
| COIL NO. | THICKNESS INCHES | CORE LOSS W/LB/15KG/60 | A.C. PEAK PERM. 15KG/60 | CORE LOSS W/LB/15KG/60 | A.C. PEAK PERM. 15KG/60 |
| 1 | 0.0180 | 4.21 | 1645 | 3.42 | 2222 |
| 2 | 0.0180 | 4.23 | 1616 | 3.42 | 2160 |
| 3 | 0.0180 | 4.24 | 1640 | 3.32 | 2363 |
| 4 | 0.0180 | 4.17 | 1648 | 3.44 | 2162 |
| 5 | 0.0220 | 4.95 | 1452 | 3.96 | 2405 |
| 6 | 0.0220 | 4.97 | 1421 | 3.94 | 2427 |
| 7 | 0.0220 | 4.57 | 1532 | 3.75 | 2165 |
| 8 | 0.0230 | 5.57 | 1366 | 4.32 | 2410 |
| 9 | 0.0230 | 5.37 | 1366 | 4.18 | 2268 |
| 10 | 0.0230 | 5.40 | 1399 | 4.14 | 2358 |
| 11 | 0.0250 | 6.06 | 1259 | 4.88 | 2045 |
| 12 | 0.0250 | 5.68 | 1295 | 4.50 | 2123 |
| 13 | 0.0250 | 5.80 | 1300 | 4.64 | 2088 |
| 14 | 0.0250 | 5.82 | 1313 | 4.65 | 2287 |
| 15 | 0.0250 | 6.13 | 1261 | 4.90 | 2389 |

| COIL NO. | HARDNESS, $R_B$ | TEST DIRECTION | 0.2% OFFSET Y.S., KSI | TENSILE STRENGTH, KSI | % ELONG. IN 2 INCHES |
|---|---|---|---|---|---|
| 1 | 64 | L | 47.1 | 62.0 | 29.0 |
| | | T | 48.1 | 62.9 | 28.5 |
| 2 | 59-64 | L | 45.0 | 60.5 | 27.0 |
| | | T | 45.6 | 61.0 | 33.0 |
| 3 | 58-61 | L | 47.0 | 61.8 | 29.5 |
| | | T | 47.8 | 63.1 | 31.5 |
| 4 | 63-64 | L | 46.8 | 61.9 | 26.0 |
| | | T | 46.3 | 61.7 | 30.0 |
| 5 | 58-64 | L | 45.7 | 61.2 | 28.0 |
| | | T | 46.4 | 62.1 | 31.0 |
| 6 | 63-64 | L | 47.2 | 62.2 | 29.0 |
| | | T | 48.9 | 63.1 | 29.0 |
| 7 | 58-59 | L | 47.2 | 61.7 | 29.0 |
| | | T | 46.9 | 62.8 | 29.0 |
| 8 | 65-67 | L | 47.4 | 61.6 | 30.5 |
| | | T | 46.4 | 62.1 | 32.0 |

TABLE -continued

| | | | | | |
|---|---|---|---|---|---|
| 9 | 64–68 | L | 47.3 | 62.8 | 29.0 |
| | | T | 48.2 | 63.7 | 30.5 |
| 10 | 64–66 | L | 48.2 | 62.9 | 30.0 |
| | | T | 48.7 | 63.4 | 32.0 |
| 11 | 67–70 | L | 48.3 | 63.8 | 32.0 |
| | | T | 49.6 | 64.5 | 33.5 |
| 12 | 67–70 | L | 48.9 | 62.4 | 30.5 |
| | | T | 48.7 | 63.2 | 33.0 |
| 13 | 68–69 | L | 47.6 | 63.4 | 31.0 |
| | | T | 48.9 | 63.7 | 32.0 |
| 14 | 67–68 | L | 48.8 | 63.0 | 31.0 |
| | | T | 48.1 | 63.6 | 32.5 |
| 15 | 66–72 | L | 48.6 | 62.5 | 30.0 |
| | | T | 48.7 | 64.1 | 31.0 |

I claim:

1. In the method for producing low-carbon electrical sheet steel, wherein a steel slab containing from 0.02 to 0.04% carbon is processed by hot rolling and cold rolling to produce a cold rolled sheet of from 0.016 to 0.036-inch thick and then continuous annealing the cold rolled sheet, the improvement comprising providing a duplex continuous anneal wherein the sheet is first heated to a temperature within the range 1350° to 1500° F. in a decarburizing atmosphere and there maintained for a time sufficient to decarburize the surfaces of the steel but insufficient to decarburize the steel's mid-section below the range 0.02 to 0.04% carbon, thereafter heating the partially decarburized steel to a temperature within the range 1550° to 1750° F. in a non-decarburizing - non-oxidizing atmosphere to substantially transform the steel's microstructure to austenite and then rapidly cooling the steel to effect a fine grained ferrite having finely dispersed carbides at the steel's mid-section and a coarse grained ferrite without any significant precipitates at the steel's surface.

2. A process according to claim 1 in which said decarburizing atmosphere consists of air containing at least 20% hydrogen with a hydrogen to water vapor ratio of from 5:1 to 8:1.

3. A process according to claim 1 in which the steel surface decarburization is effected to a depth of at least 2.0 mils.

4. A process according to claim 1 in which the steel surface decarburization is effected to a depth of at least 3.5 mils.

5. A low-carbon electrical sheet steel having excellent magnetic properties and improved punchability characterized by a duplex microstructure consisting essentially of a mid-section of fine grained ferrite containing about 0.02 to 0.04% carbon and having a finely dispersed carbide precipitate therein and a surface layer of coarse grained ferrite containing less than 0.005% carbon and having no significant precipitates.

6. A low-carbon electrical sheet steel according to claims 5 in which said surface layer is at least 2.0 mils thick.

7. A low-carbon electrical sheet steel according to claims 5 in which said surface layer is at least 3.5 mils thick.

8. A fully processed, low-carbon electrical sheet steel having excellent punchability and excellent magnetic properties without a final lamination anneal, characterized by a duplex microstructure consisting essentially of a mid-section of fine grained ferrite having a finely dispersed carbide precipitate therein and a surface layer at least 3.5 mils thick of coarse grained ferrite without significant precipitates.

* * * * *